US010159287B2

(12) United States Patent
Qiu

(10) Patent No.: US 10,159,287 B2
(45) Date of Patent: Dec. 25, 2018

(54) ATOMIZING HEAD, ATOMIZING DEVICE AND ELECTRONIC CIGARETTE

(71) Applicant: Joyetech Europe Holding GmbH, Zug (CH)

(72) Inventor: Weihua Qiu, Jiangsu (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 0 days.

(21) Appl. No.: 15/664,494

(22) Filed: Jul. 31, 2017

(65) Prior Publication Data

US 2018/0035720 A1 Feb. 8, 2018

(30) Foreign Application Priority Data

Aug. 2, 2016 (CN) ..... 2016 2 0826293 U

(51) Int. Cl.
*A24F 47/00* (2006.01)
*F22B 1/28* (2006.01)
*H05B 3/44* (2006.01)

(52) U.S. Cl.
CPC ..... *A24F 47/008* (2013.01); *F22B 1/284* (2013.01); *H05B 3/44* (2013.01)

(58) Field of Classification Search
CPC ..... A24F 47/008
See application file for complete search history.

(56) References Cited

U.S. PATENT DOCUMENTS 9,814,269 B2 * 11/2017 Li ..... H05B 3/44
2018/0035720 A1 * 2/2018 Qiu ..... H05B 3/44

* cited by examiner

*Primary Examiner* — James Harvey
(74) *Attorney, Agent, or Firm* — Novick, Kim & Lee, PLLC; Allen Xue

(57) ABSTRACT

An atomizing head is disclosed, including a heating component, a liquid absorption component and at least one contact ring, wherein the liquid absorption component is wrapped around the outer circumference of the heating component, the contact ring includes a base and a first clamping flange extending at a certain angle from an circumferential edge of the base, the base covers one end of the heating component in an axis direction of the heating component, the first clamping flange presses against an outer surface of the liquid absorption component to fasten the liquid absorption component onto the heating component. During the assembling process of the atomizing head, it only requires the liquid absorption component to wrap around the heating component and be pressed against and fastened by the contact ring.

10 Claims, 5 Drawing Sheets

ATOMIZING HEAD, ATOMIZING DEVICE AND ELECTRONIC CIGARETTE

FIELD

The present disclosure relates to the field of smoking simulation, and more particularly, to an atomizing head, an atomizing device and an electronic cigarette.

BACKGROUND

In a conventional electronic cigarette, the atomizing head is generally wrapped with cotton. The cotton needs to be replaced frequently due to damage or other reasons. The replacing process is very complicated since the user needs to wrap the cotton onto the heating component. This is inconvenient to the user, and the user experience is relatively poor. On the other hand, the user may choose to replace the whole atomizing head, which is convenient, but its cost is high, and is a big waste.

SUMMARY

In view of the above deficiencies in the prior art, an objective of the present disclosure is to provide an atomizing head which can be replaced and used easily.

Another objective of the present disclosure is to provide an atomizing device with the atomizing head.

A further objective of the present disclosure is to provide an electronic cigarette with the atomizing device.

According to an aspect of the present disclosure, an atomizing head is provided, which includes a heating component, a liquid absorption component and at least one contact ring. The liquid absorption component is wrapped around the outer circumference of the heating component. The contact ring includes a base and a first clamping flange extending at a certain angle from a circumferential edge of the base. The base covers one end of the heating component in an axis direction of the heating component. The first clamping flange presses against an outer surface of the liquid absorption component to fasten the liquid absorption component onto the heating component.

In one embodiment, the contact ring further includes a second clamping flange provided on the base. The first clamping flange and the second clamping flange are separated from each other on the base and extend towards a same direction along the axis direction of the heating component. A groove configured to receive a circumferential edge of the heating component wrapped with the liquid absorption component is defined between the first clamping flange and the second clamping flange.

In one embodiment, the heating component is one of a Clapton heating coil, a heating wire with a diameter of 0.1-1 mm, and a steel heating wire, or any combination thereof.

In one embodiment, the heating component is a hollow heating tube with a plurality of pores arranged thereon.

In one embodiment, each pore has a diameter of 0.1 to 5 mm, and the distance between centers of two adjacent pores is greater than the diameter of the pore.

In one embodiment, the heating component has a cylindrical structure rolled by a heating sheet with a plurality of pores formed thereon, and the contact ring is formed integrally with the heating sheet.

In one embodiment, the contact rings are in the form of clamping flanges punched at the two ends of the heating sheet, respectively.

In one embodiment, the at least one contact ring includes two contact rings made of flexible metal sheets, the two contact rings are fastened to and contact both ends of the heating component in the axis direction of the heating component, so as to serve as a positive electrode and a negative electrode of the atomizing head, respectively.

According to another aspect of the present disclosure, an atomizing device is provided, which has the above atomizing head.

According to a further aspect of the present disclosure, an electronic cigarette is provided, which has the above atomizing device.

During the assembling process of the atomizing head of the present disclosure, it only requires the liquid absorption component to wrap around the heating component and be pressed against and fastened by the contact ring. Such an assembling process is simple, and the atomizing head is easy to replace at a low cost.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like components of an embodiment.

DETAILED DESCRIPTION OF PREFERRED EMBODIMENTS

In the following description of embodiments, reference is made to the accompanying drawings which form a part hereof, and in which it is shown by way of illustration specific embodiments of the present invention that can be practiced. It is to be understood that other embodiments can be used and structural changes can be made without departing from the scope of the disclosed embodiments.

When a feature or component is herein referred to as being "on" another feature or component, it can be directly on the other feature or component or intervening features and/or components may also be present. It will also be understood that, when a feature or component is referred to as being "connected", "attached" or "coupled" to another feature or component, it can be directly connected, attached or coupled to the other feature or component or intervening features or components may be present.

Terminology used herein is for the purpose of describing particular embodiments only and is not intended to be limiting of the invention. As used herein, the term "and/or"

includes any and all combinations of one or more of the associated listed items and may be abbreviated as "/".

Figure 1:
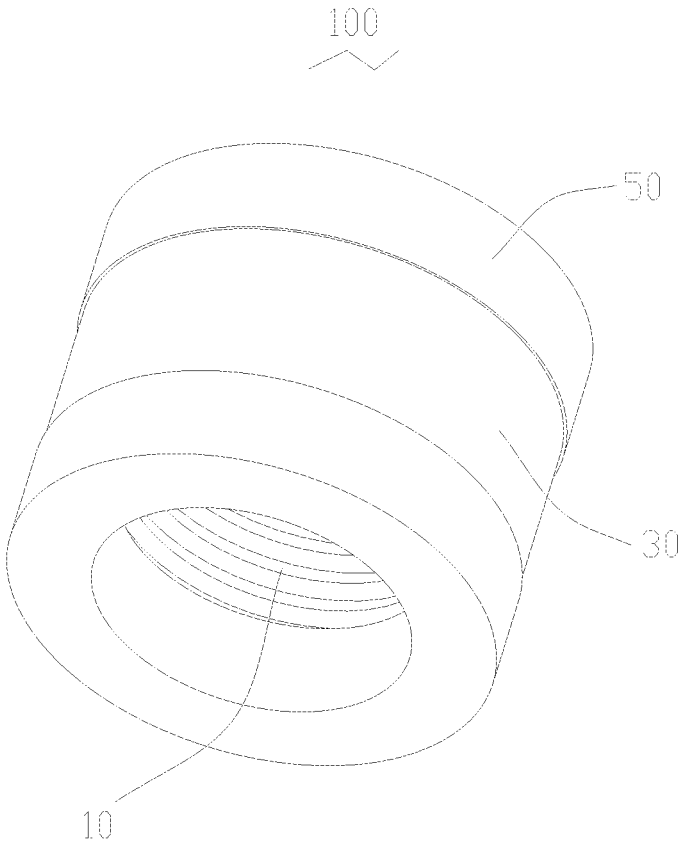
FIG. 1 is a structural schematic diagram illustrating an atomizing head according to a first embodiment of the present disclosure.

With reference to FIG. 1, in an embodiment of the present disclosure, the atomizing head 100 includes a heating component 10, a liquid absorption component 30 and at least one contact ring 50. The liquid absorption component 30 wraps around the outer circumference of the heating component 10 and is fixed by the contact ring 50. In this way, when the heating component 10 is energized, the tobacco liquid absorbed on the liquid absorption component 30 can be atomized into smoke by the heating component 10. The smoke then enters the mouth of the smoker through a smoke discharging channel (not shown) when a suction action is conducted by the smoker.

Figure 2:
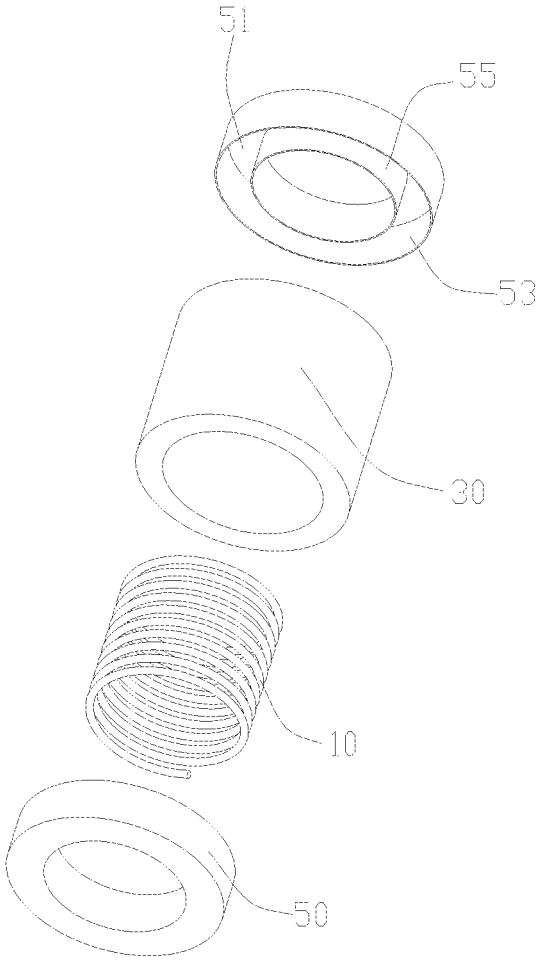
FIG. 2 is an exploded view of the atomizing head shown in FIG. 1.
Figure 3:
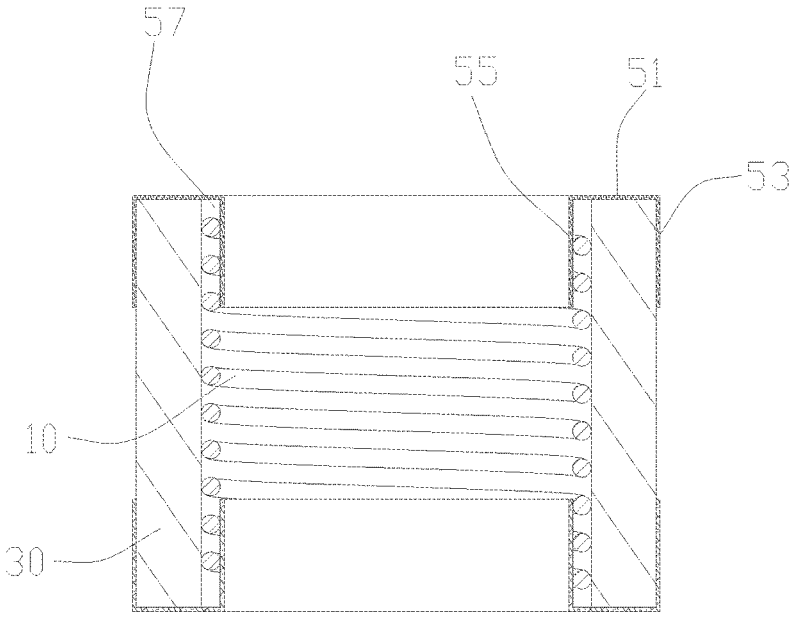
FIG. 3 is a cross-sectional view of the atomizing head shown in FIG. 1.

With reference to FIGS. 2 and 3, in a first embodiment of the present disclosure, the heating component 10 is a heating wire of a hollow cylindrical structure, and the liquid absorption component 30 is a porous component wrapped around the heating wire. The liquid absorption component 30 may be selected from any one of cotton, cotton fabric, fiber rope, porous ceramic, foam metal, foam graphite and other porous components.

The contact ring 50 includes a base 51 and a first clamping flange 53 extending at a certain angle from a circumferential edge of the base 51. The base 51 covers one end of the heating component 10 in the axis direction of the heating component 10 and communicates with the inner cavity of the heating component 10. The first clamping flange 53 extends along the axis direction of the heating component 10 from the circumferential edge of the base 51, and presses against the outer surface of the liquid absorption component 30 to fasten the liquid absorption component 30 onto the heating component 10, so that the liquid absorption component 30 and the heating component 10 are assembled into a whole.

In this embodiment, the contact rings 50 further includes a second clamping flange 55 provided on the base 51 and is separated from the first clamping flange 53. The base 51 is in the shape of a hollow ring. The first clamping flange 53 extends towards the axis direction of the heating component 10 from the edge of the external circle of the base 51, and the second clamping flange 55 extends towards the same direction as the first clamping flange 53 from the inner circumference of the base 51. In this case, the first clamping flange 53 and the second clamping flange 55 form two coaxial hollow circular cylinders at the internal and external circles, respectively, and the two coaxial hollow circular cylinders define a groove 57 therebetween. The groove 57 is adapted to receive a circumferential edge of the heating component 10 wrapped with the liquid absorption component 30.

It will be appreciated that the structure of the contact ring 50 may be determined according to the structure of the heating component 10 in other embodiments. For example, the first clamping flange 53 of the contact ring 50 may be designed to have a L-shaped structure extending from the circumferential edge of the base 51, and the second clamping flange 55 may be omitted. In addition, in other embodiments, the shapes of the first clamping flange 53 and the second clamping flange 55 may also be determined as needed. For example, each of the first clamping flange 53 and the second clamping flange 55 may be designed to have a plurality of clamping strips extending along the axis direction of the heating component 10, and the plurality of clamping strips are separated from each other in the internal and external circles of the contact ring 50 respectively. The clamping strips of the first clamping flange 53 may correspond to the clamping strips of the second clamping flange 55, or the clamping strips of the first clamping flange 53 and the clamping strips of the second clamping flange 55 may be arranged in a staggered manner. The arrangement is not limited here, provided that the liquid absorption component 30 can be fastened to and engaged with the heating component 10.

Further, there may be two contact rings 50 made of elastic metal sheets. The two contact rings 50 are fastened to and contact with both ends of the heating component 10 in the axis direction of the heating component 10, so as to serve as a positive electrode and a negative electrode of the atomizing head 100, respectively. In such a way, when the heating component 10 and the liquid absorption component 30 are assembled together through the contact rings 50, an electrical path between the atomizing head 100 and a battery device (not shown) providing electrical drive is formed, such that the heating component 10 atomizes the tobacco liquid absorbed by the liquid absorption component 30 in accordance with a user operation. This shows the atomizing head 100 is easy to assemble and use.

Further, in order to allow the atomizing head 100 to have a supporting function, the heating component 10 may be preferably one of a Clapton heating coil, a heating wire with a diameter of 0.1-1 mm, and a steel heating wire, or any combination thereof. If the heating component 10 is a nickel heating wire, it is preferably a nickel Clapton heating coil or a nickel heating wire with a diameter of 0.1-1 mm.

Figure 4:
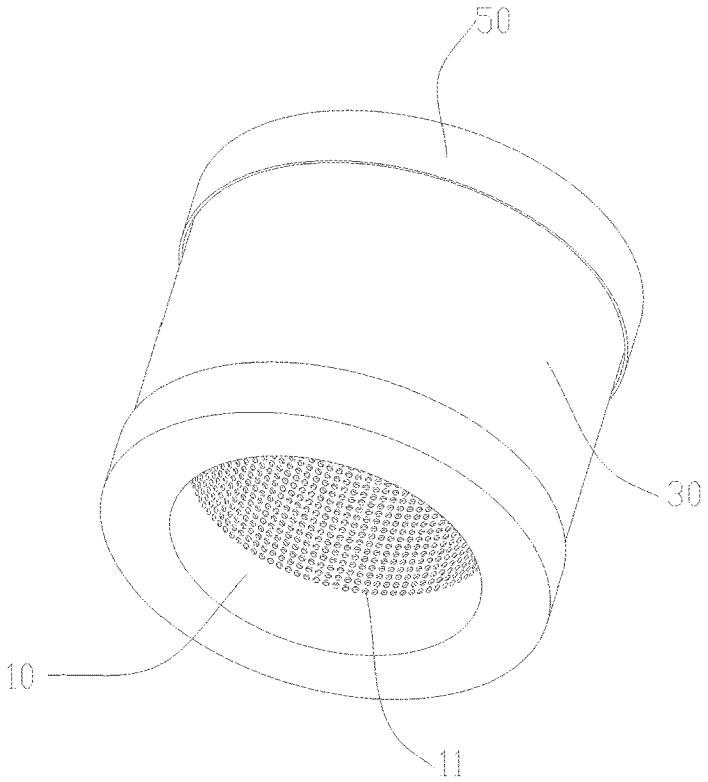
FIG. 4 is a structural schematic diagram illustrating an atomizing head according to a second embodiment of the present disclosure.
Figure 5:
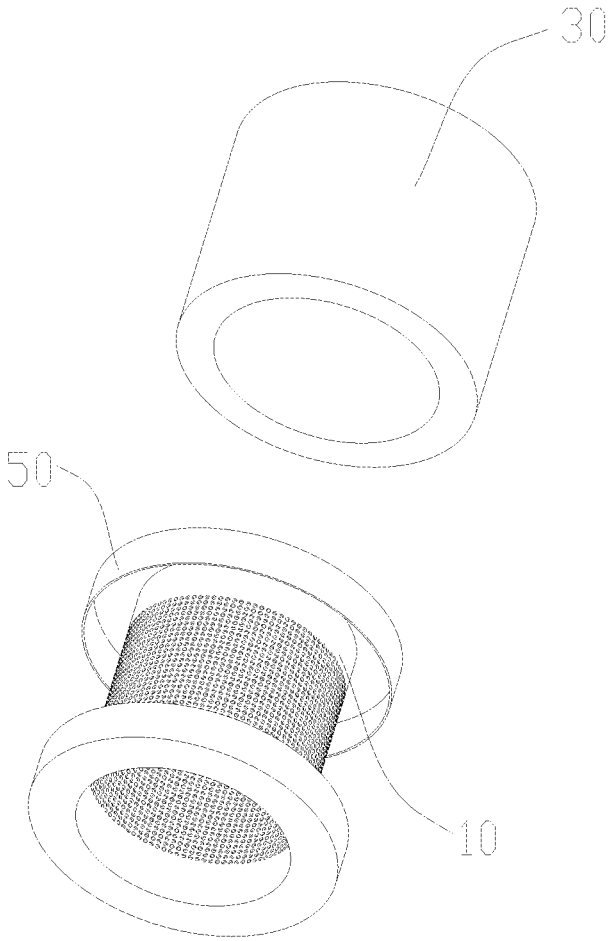
FIG. 5 is an exploded view of the atomizing head shown in FIG. 4.

With reference to FIGS. 4 and 5, in a second embodiment of the present disclosure, the heating component 10 is a hollow heating tube provided with a plurality of pores 11. The liquid absorption component 30 wraps around the heating component 10. When the heating component 10 is energized, the heating component 10 may generate a high temperature to atomize the tobacco liquid absorbed on the liquid absorption component 30 wrapped around the heating component 10, to create smoke. The smoke may flow out through the pores 11 in the heating component 10 and enter the smoke discharging channel (not shown), and then be brought into the mouth of the smoker with the flow.

Figure 6:
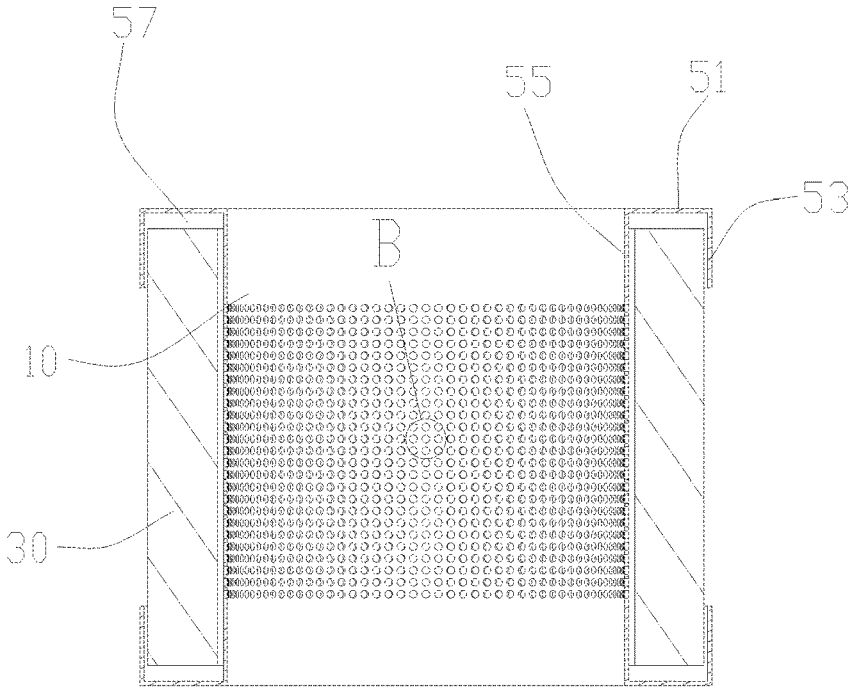
FIG. 6 is a cross-sectional view of the atomizing head shown in FIG. 4.
Figure 7:
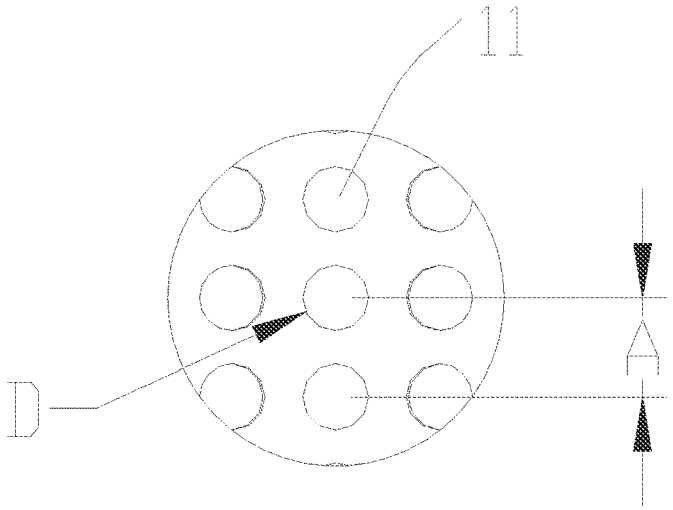
FIG. 7 is an enlarged view of the portion B of the atomizing head shown in FIG. 6.

With reference to FIGS. 6 and 7, when the heating component 10 is a heating tube, chemical corrosion or laser engraving may be conducted to the heating tube (such as nickel tube or steel tube) to form a porous hollow metal cylinder with extremely tiny pores 11. Each pore has a diameter D of 0.1 to 5 mm, and the distance A between centers of two adjacent pores is greater than the diameter of the pore, that is, A>D.

In the case where the heating component 10 is a heating sheet, the heating component 10 is formed by providing pores 11 on the heating sheet (such as nickel sheet or steel sheet), rolling the heating sheet into a cylindrical structure with a welding technology, and punching both ends of the cylindrical structure to form two contact rings 50 in the shape of a flange, and the contact rings 50 are adapted to cover the porous liquid absorption component 30 outside the heating component 10. Meanwhile, the contact rings 50 in the shape of a flange have larger contact areas, and are easy to form positive and negative electrodes.

In the case that the heating component 10 is the above-mentioned heating tube or heating sheet, it is also advantageous to increase the heating area of the heating component 10, and make the heating component 10 to generate heat uniformly to avoid damaging the liquid absorption component 30 due to local overheating.

During assembling of the atomizing head 100 when the atomizing head 100 is required to be replaced, the liquid absorption component 30 may wrap around the heating component 10, the two contact rings 50 may be inserted into the inner cavity of the heating component 10 through the respective second clamping flanges 55, and the second clamping flanges 55 may contact the inner wall of the heating component 10, so that the edge of the heating component 10 wrapped with the liquid absorption component 30 in the circumference direction of the heating component 10 is nested and fastened within the groove 57. Meanwhile, the two contact rings 50 form the positive electrode and the negative electrode of the heating component 10, respectively, such that an electrical path between the atomizing head 100 and a battery device may be formed, and that the heating component 10 may heat and atomize the tobacco liquid absorbed on the liquid absorption component 30.

During the assembling process of the atomizing head 100 of the present disclosure, it only requires the liquid absorption component 30 to wrap around the heating component 10 and be pressed against and fastened by the contact rings 50. Such assembling process is simple, and the atomizing head is easy to replace at a low cost. Meanwhile, the contact rings 50 may serve as a positive electrode and a negative electrode of the heating component 10, so that when the atomizing head 100 is electrically connected to the battery device after assembly, an electrical path may be formed, and the tobacco liquid absorbed on the liquid absorption component 30 may be heated to create smoke.

The present disclosure also provides an atomizing device (not shown) having the atomizing head 100 and the smoking discharging channel which is in fluid communication with the atomizing head 100.

The present disclosure further provides an electronic cigarette (not shown) having the above atomizing device.

The above are embodiments of the present disclosure described in detail, and should not be deemed as limitations to the scope of the present disclosure. It should be noted that variations and improvements will become apparent to those skilled in the art to which the present disclosure pertains without departing from its spirit and scope. Therefore, the scope of the present disclosure is defined by the appended claims.

What is claimed is:

1. An atomizing head, comprising a heating component, a liquid absorption component and at least one contact ring, wherein the liquid absorption component is wrapped around the outer circumference of the heating component, the contact ring includes a base and a first clamping flange extending at a certain angle from a circumferential edge of the base, the base covers one end of the heating component in an axis direction of the heating component, the first clamping flange presses against an outer surface of the liquid absorption component to fasten the liquid absorption component onto the heating component.

2. The atomizing head according to claim 1, wherein the contact ring further includes a second clamping flange provided on the base, the first clamping flange and the second clamping flange are separated from each other on the base and extend towards a same direction along the axis direction of the heating component, a groove configured to receive an circumferential edge of the heating component wrapped with the liquid absorption component is defined between the first clamping flange and the second clamping flange.

3. The atomizing head according to claim 1, wherein the heating component is one of a fancy heating wire, a heating wire with a diameter of 0.1-1 mm, and a steel heating wire, or any combination thereof.

4. The atomizing head according to claim 1, wherein the heating component is a hollow heating tube with a plurality of pores arranged thereon.

5. The atomizing head according to claim 4, wherein each pore has a diameter of 0.1 to 5 mm, and the distance between centers of two adjacent pores is greater than the diameter of the pore.

6. The atomizing head according to claim 1, wherein the heating component has a cylindrical structure rolled by a heating sheet with a plurality of pores formed thereon, and the contact ring is formed integrally with the heating sheet.

7. The atomizing head according to claim 6, wherein the contact rings are in the form of clamping flanges punched at the two ends of the heating sheet respectively.

8. The atomizing head according to claim 1, wherein the at least one contact ring includes two contact rings made of flexible metal sheets, the two contact rings are fastened to and contact with both ends of the heating component in the axis direction of the heating component, so as to serve as a positive electrode and a negative electrode of the atomizing head respectively.

9. An atomizing device comprising the atomizing head according to claim 1.

10. An electronic cigarette comprising the atomizing device according to claim 9.

* * * * *